US009957087B2

(12) United States Patent
Takigawa

(10) Patent No.: US 9,957,087 B2
(45) Date of Patent: May 1, 2018

(54) CHILD-RESISTANT ZIPPER AND PACKAGING BAG INCORPORATING SAID ZIPPER

(71) Applicant: Takigawa Corporation, Chiba Prefecture (JP)

(72) Inventor: Hiroyuki Takigawa, Chiba Prefecture (JP)

(73) Assignee: Takigawa Corporation Japan, Chiba Prefecture (JP)

( * ) Notice: Subject to any disclaimer, the term of this patent is extended or adjusted under 35 U.S.C. 154(b) by 0 days. days.

(21) Appl. No.: 14/710,178

(22) Filed: May 12, 2015

(65) Prior Publication Data

US 2016/0122087 A1 May 5, 2016

(30) Foreign Application Priority Data

Oct. 31, 2014 (JP) ..... 2014-222237

(51) Int. Cl.
*B65D 33/00* (2006.01)
*B65D 33/25* (2006.01)
*A44B 19/24* (2006.01)

(52) U.S. Cl.
CPC ..... *B65D 33/2508* (2013.01); *A44B 19/24* (2013.01)

(58) Field of Classification Search
CPC ..... B65D 33/2541; B65D 33/2508; B29C 66/71; B29C 65/00; A44B 19/16
(Continued)

(56) References Cited

U.S. PATENT DOCUMENTS 4,528,224 A * 7/1985 Ausnit ..... B29C 66/61 156/204
4,673,383 A * 6/1987 Bentsen ..... B29C 65/10 156/244.15

(Continued)

FOREIGN PATENT DOCUMENTS

JP 2001-322652 A 11/2001
JP 3655104 B2 6/2005

*Primary Examiner* — Peter Helvey
(74) *Attorney, Agent, or Firm* — Cesari and McKenna, LLP

(57) ABSTRACT

A child-resistant zipper is provided and a packaging bag incorporating such a zipper which is difficult for a child to open, but which can readily be opened using predetermined procedures. The zipper comprises first and second adhesion band members each comprising an upper and lower surface on upper and lower ends thereof, one surface of which is an adhesive surface for adherence to opposing inner surfaces of an opening of a packaging bag, and a fit-engagement body comprising first and second fit-engagement portions respectively provided on opposing surfaces of the adhesion band members, wherein the first and second fit-engagement portions are adapted to releasably engage with each other to form a fit-engagement body, wherein the adhesive surface of the first adhesion band member is provided on its lower surface to form a lower surface adhering fit-engagement body in which the fit-engagement portion of the first band adhesion member is arranged along the upper end of the first adhesion band member, and wherein a releasing member is provided on the upper end of the first adhesion band member of the lower surface adhering fit-engagement body which is adapted to release engagement of the fit-engagement body when the releasing member and the second adhesion band member are opened in opposite directions.

4 Claims, 10 Drawing Sheets

(58) Field of Classification Search
USPC ..... 383/61.2, 61.3, 63, 64
See application file for complete search history.

(56) References Cited

U.S. PATENT DOCUMENTS

| | | | | | |
|---|---|---|---|---|---|
| 4,817,188 | A * | 3/1989 | Van Erden | B31B 19/90 | 24/287 |
| 4,878,763 | A * | 11/1989 | Ausnit | B65D 33/2508 | 24/585.12 |
| 5,017,021 | A * | 5/1991 | Simonsen | B65D 33/2541 | 383/63 |
| 5,558,613 | A * | 9/1996 | Tilman | B65D 33/2541 | 493/212 |
| 5,972,396 | A * | 10/1999 | Jurgovan | B65D 33/2533 | 206/810 |
| 6,004,032 | A * | 12/1999 | Kapperman | B65D 33/2516 | 24/585.12 |
| 6,389,651 | B2 * | 5/2002 | Johnson | 24/30.5 R | |
| 6,550,965 | B2 * | 4/2003 | Shaffer | B31B 19/64 | 24/585.12 |
| 7,437,805 | B2 * | 10/2008 | Berich | B65D 33/01 | 24/399 |
| 7,784,160 | B2 * | 8/2010 | Dais | B65D 33/2508 | 24/585.12 |
| 7,886,412 | B2 * | 2/2011 | Dais | B65D 81/2023 | 24/399 |
| 2001/0002218 | A1 * | 5/2001 | Shaffer | B31B 19/64 | 383/65 |
| 2002/0162200 | A1 * | 11/2002 | Offa-Jones | B65D 33/2541 | 24/585.1 |
| 2006/0111226 | A1 * | 5/2006 | Anzini | B65D 33/2508 | 493/214 |
| 2008/0232722 | A1 * | 9/2008 | Pawloski | B65D 33/2508 | 383/64 |
| 2010/0014786 | A1 * | 1/2010 | Pawloski | B65D 33/01 | 383/59 |
| 2010/0069211 | A1 * | 3/2010 | Anzini | B31B 19/90 | 493/213 |
| 2012/0045151 | A1 * | 2/2012 | Eouzan | B65D 33/2541 | 383/42 |
| 2014/0161374 | A1 | 6/2014 | Septien Rojas et al. | | |

* cited by examiner

CHILD-RESISTANT ZIPPER AND PACKAGING BAG INCORPORATING SAID ZIPPER

CROSS-REFERENCE TO RELATED APPLICATIONS

This application claims the benefit of Japanese Application No. 2014-222,237, filed on Oct. 31, 2014, the content of which is hereby incorporated in its entirety.

BACKGROUND OF THE INVENTION

Field of the Invention

The present invention relates to a child-resistant zipper and a packaging bag including such a zipper to hinder unwanted opening of the zipper, for example, by a child, etc., but which is readily opened by predetermined procedures.

Background Information

The term "child-resistant" refers to a function/mechanism by means of which it is possible to prevent an object from being easily manipulated, for example, by a child or other similar individual. Due to this function, a child is hindered or prevented, for example, from tampering with a lighter, and from easily opening a container of medicine, etc.

That is, some packaging bags accommodate objects which should not be touched by children, etc. In this case, in order to hinder access of packaging bag contents to a child, etc., e.g. to open a zippered bag even after a seal of the bag has been opened, there is a demand for a child-resistant zipper for packaging bags to make it difficult for the bag to be opened based on the strength of a child by enhancing the strength of the releasable engagement or fit-engagement of the zipper.

On the other hand, a packaging bag including a sealing zipper which can be easily opened and closed, may be used for various applications. In the packaging bag disclosed in Japanese Patent Application No. 2001-322652, a zipper is provided which extends along a seal formed by fusion-bonding of the opening of the bag. After opening this seal, the zipper can be opened and closed. Since the zipper can be opened and closed arbitrarily, by thus providing the seal along the zipper, it is possible to prevent the zipper from being opened or closed while being sold.

By enhancing the fit-engagement strength of the zipper or by adhering a seal, etc., to the opening, it is possible to make it difficult for the zipper to be opened by tampering by a child, etc. On the other hand, however, a zipper of a high fit-engagement strength is made difficult to open and close; each time it is to be opened, there is required additional time and effort to peel the seal, etc., resulting in inconvenience at the time of use.

Furthermore, when the zipper packaging bag contains something heavy, the object may be expanded within the packaging bag, causing the zipper to be inadvertently opened. In view of this, the fit-engagement strength of the zipper is enhanced; also in this case, the zipper of an enhanced fit-engagement strength is made difficult to open or close, resulting in inconvenience at the time of use.

In this way, it is rather difficult for conventional zipper packaging bags to prevent opening by a child, etc., the conventional zipper packaging bag of an enhanced fit-engagement strength involves inconvenience at the time of use.

SUMMARY OF THE INVENTION

The present invention has been made with a view toward solving at least one of the above problems.

In a first aspect according to the present invention, there is provided a child-resistant zipper equipped with a first and second adhesion band members respectively adhered to inner opposing surfaces of an opening P2 of a packaging bag, and first and second fit-engagement portions respectively provided on the opposing surfaces of the adhesion band members, with the fit-engagement portions being adapted for releasable fit-engagement with each other, wherein the adhesive surface of the first adhesion band member is provided on its lower surface to provide a lower surface adhering fit-engagement body in which the fit-engagement portion of the first adhesion band member is arranged along the upper end of the first adhesion band member 1, and wherein there is provided a releasing member on the upper end of the adhesion band member of the lower surface adhering fit-engagement body, the releasing member being adapted to release engagement of the fit-engagement body 2 when the releasing member and the second adhesion band member are opened in opposite directions.

In one embodiment, there is provided a zipper wherein, on the second adhesion band member opposite the lower surface adhering fit-engagement body, there is provided an upper surface adhering fit-engagement body in which the adhesive surface of the second adhesion band member is provided on the upper surface thereof and the fit-engagement portion is arranged on the lower end of the second adhesion band member.

In another embodiment, there is provided a zipper, wherein one of the first and second fit-engagement portions comprises at least one male fit-engagement protrusion and the other fit-engagement portion comprises at least one female fit-engagement recess configured to be fit-engaged in a rib-like or face-like manner, wherein the fit-engagement of the first and second fit-engagement portions is released by inserting an item between the male fit-engagement protrusion and the female fit-engagement recess at the releasing member 3 side of the lower surface adhering fit-engagement body.

In another aspect, there is provided a zippered packaging bag equipped with a pair of opposing sides, first and second adhesion band members, each comprising an upper and lower surface on upper and lower ends thereof, one surface of which is an adhesive surface adhered to the inner opposing surfaces of the sides of the packaging bag, and a zipper comprising first and second fit-engagement portions respectively provided on opposing surfaces of the adhesion band members and configured to releasably fit-engage to form a fit-engagement body, wherein the adhesive surface of the first adhesion band member is on its lower surface to provide a lower surface adhering fit-engagement body in which the first fit-engagement portion is arranged along the upper end of the first adhesion band member, and the adhesive surface of the second adhesion band member is on its upper surface to provide an upper surface adhering fit-engagement body in which the second fit-engagement portion is arranged on the lower end of the second band adhesion member, and wherein there is provided a releasing member on the upper end of the first adhesion band member of the lower surface adhering fit-engagement body, the releasing member being adapted to release engagement of the fit-engagement body when the releasing member and the second adhesion band member are opened in opposite directions.

Thus, when the packaging bag is opened, there is no force applied to the fit-engagement portion of the lower surface adhering fit-engagement body, and the engaged fit-engagement body is not released from engagement. The fit-engagement body is opened or released from engagement when the releasing member of the lower surface adhering fit-engagement body and the second band adhesion member are opened in opposite directions, thereby providing a child-resistant zipper which is difficult to open by a child, or similar individual, but which can readily be opened by predetermined procedures.

That is, even if the opening of the packaging bag is opened by the normal procedures, there is no opening force applied to the fit-engagement portion of the lower surface adhering fit-engagement body, and so the bag is not opened, thereby preventing opening by a child, etc., without especially enhancing the fit-engagement strength of the fit-engagement body.

Furthermore, there is no opening force applied to the fit-engagement portion of the upper surface adhering fit-engagement body when a bag incorporating the zipper accommodates a heavy load. Moreover, even if the load is expanded within the packaging bag, the fit-engagement portion 2 is prevented from being opened.

The zipper may be formed by an appropriate number of rib-type or face-type male fit-engagement portions 2A and female fit-engagement portions 2B, whereby it is possible to select an arbitrary type of zipper. Furthermore, the fit-engaged fit-engagement portion 2 is opened by inserting a finger between the male fit-engagement portion 2A and the female fit-engagement portion 2B from the releasing member 3 side, so that, even if the fit-engagement strength of the fit-engagement portion 2 is enhanced, the zipper can be easily opened by predetermined procedures.

In the zipper packaging bag, the fit-engagement portion 2 is not opened even if the packaging bag is opened, and the fit-engagement portion is opened by using the releasing portion; thus, it is possible to provide various packaging bags according to various applications, such as a tamper-free packaging bag, and a packaging bag for accommodating heavy objects.

In this way, a child-resistant zipper and a packaging bag incorporating the zipper, which is difficult to open by a child but which is readily opened by predetermined procedures is provided.

BRIEF DESCRIPTION OF THE DRAWINGS

The invention description below refers to the accompanying drawings, of which.

DETAILED DESCRIPTION

The zipper according to an embodiment of the present invention may be, for example, a polyethylene or polypropylene resin zipper, in which a fit-engagement portion 2 is releasably fit-engaged. Basically, the zipper is formed by providing the fit-engagement body 2 on first and second adhesion band members 1.

Figure 2:
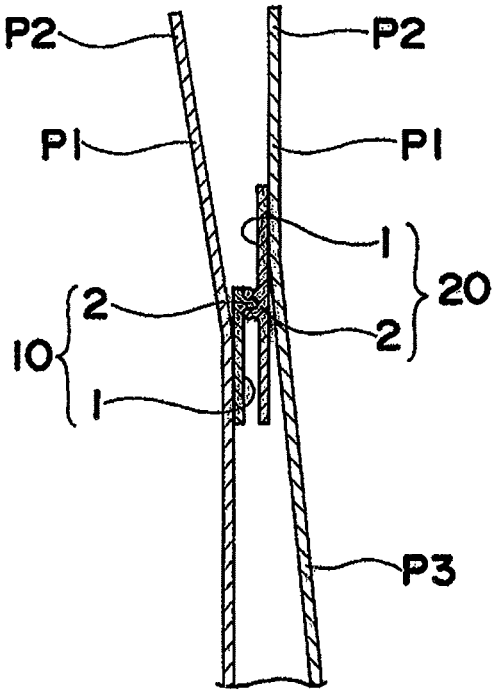
FIG. 2 is a side sectional view taken along arrow line II-II of FIG. 1.
Figure 4:
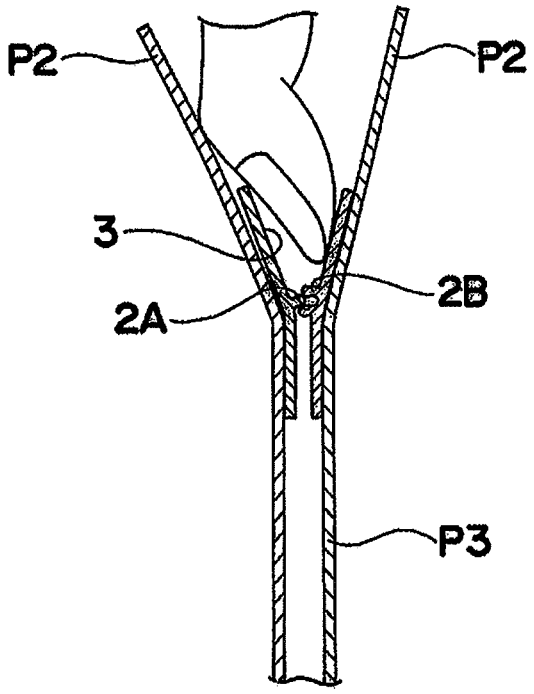
FIG. 4 is a side sectional view showing a state in which the packaging bag is opened along the arrow line of FIG. 1.
Figure 5:
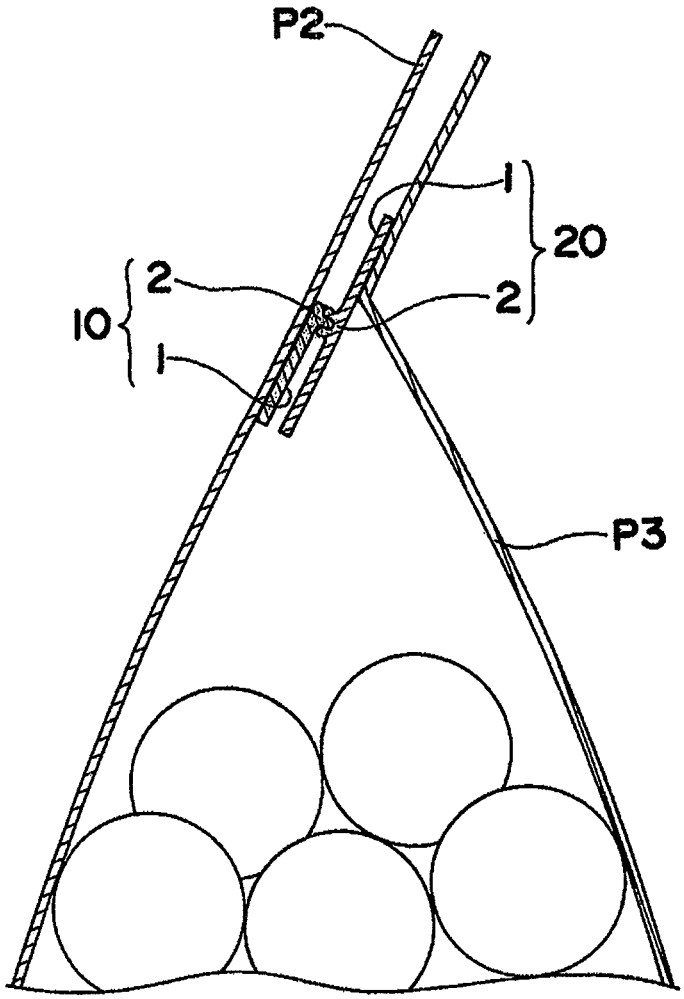
FIG. 5 is a side sectional view showing a lock structure when the inside of the packaging bag is expanded.
Figure 9:
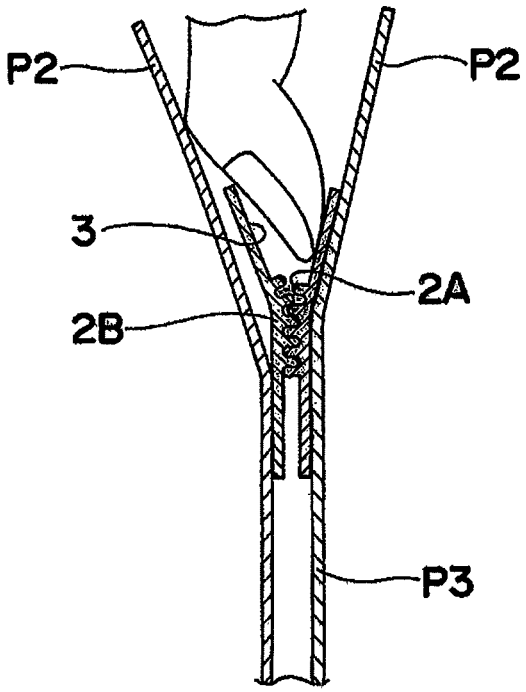
FIG. 9 is a side sectional view showing a state in which the opening of the packaging bag is widened along arrow line VII-VII of FIG. 6.

The adhesion band members 1 are band-like members respectively adhered to the inner opposing side surfaces of a packaging bag, for example, formed by a pair of resin sheets P1 superimposed one upon the other at the opening P2 of a packaging bag P, such as a laminated polyester or polyethylene structure (See FIGS. 2 and 5). The fit-engagement body 2 is a fit-engagement member comprising first and second fit-engagement portions. The first fit-engagement portion comprises at least one male fit-engagement protrusion 2A and the second fit-engagement portion comprises at least one female fit-engagement recess 2B. The first and second fit-engagement portions are situated on opposing inner side surfaces of the adhesion band members 1 and extend in the longitudinal direction along the adhesion band members 1 (See FIGS. 4 and 9).

Each adhesion band member 1 comprises upper and lower side surfaces at upper and lower ends thereof, respectively, for placement against resin sheets P1. For each pair of adhesion band members 1, the lower side surface of one adhesion band member 1 is an adhesive surface, while the upper side surface of the other adhesion band member 1 is an adhesive surface such that the position of the fit-engagement body 2 is substantially centered therebetween. Thus, for each pair of adhesion band members 1 adhered to opposing side surfaces of a packaging bag, there is formed the lower surface adhering fit-engagement body 10 and the upper surface adhering fit-engagement body 20, respectively (See FIGS. 2 and 7).

Figure 3:
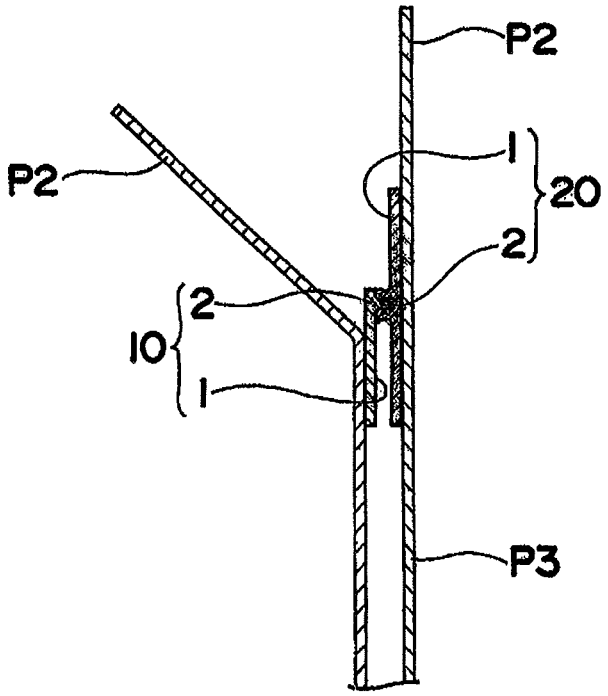
FIG. 3 is a side sectional view showing a lock structure when the opening is widened.
Figure 8:
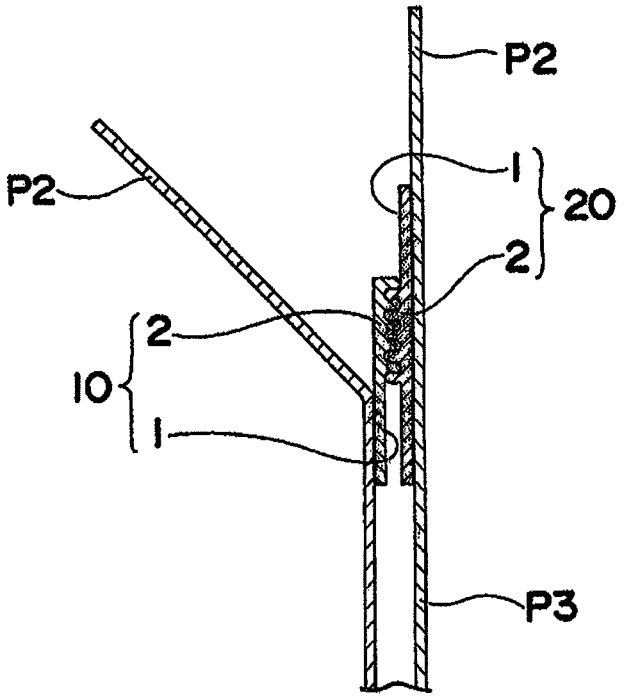
FIG. 8 is a side sectional view showing a lock structure when the opening is widened.

That is, in the case of the lower surface adhering fit-engagement body 10, the adhesive surface of the adhesion band member 1 adhered to the side of a packaging bag P1 is situated on the lower end of the fit-engagement body 2 of one adhesion band member 1 (i.e. the end closest to the interior portion P3 of the bag P), and the fit-engagement portion 2 is arranged to extend along the upper end of this adhesion band member 1 (See FIG. 2). In this lower surface adhering fit-engagement body 10, the upper surface of the adhesion band member 1, e.g. the portion where the fit-engagement portion 2 is provided (i.e. closest to the opening P2 of the bag) is not adhered to the side of the packaging bag P1. Thus, when the fit-engagement body 2 is engaged (by engagement of fit-engagement protrusion 2A and fit-engagement recess 2B) there is formed a lock structure in which the opening of P2 of the bag is not applied to the fit-engagement portion 2 of the lower surface adhering fit-engagement body 10 side, and the fit-engagement body 2 remains fully engaged (See FIGS. 3 and 8).

Figure 1:
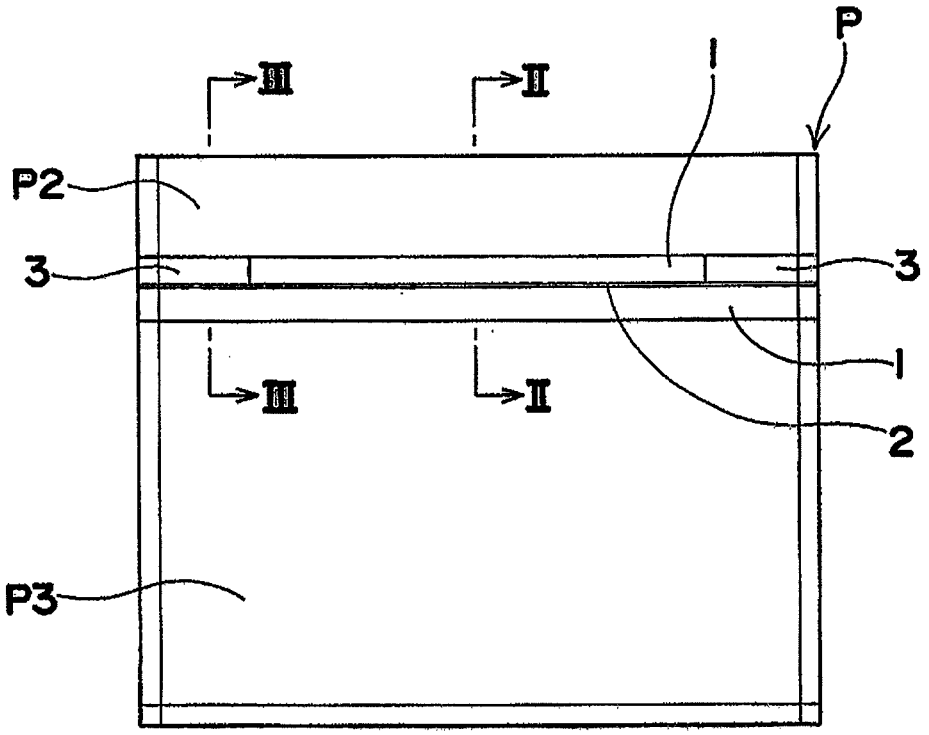
FIG. 1 is a front view of an embodiment of the present invention.
Figure 6:
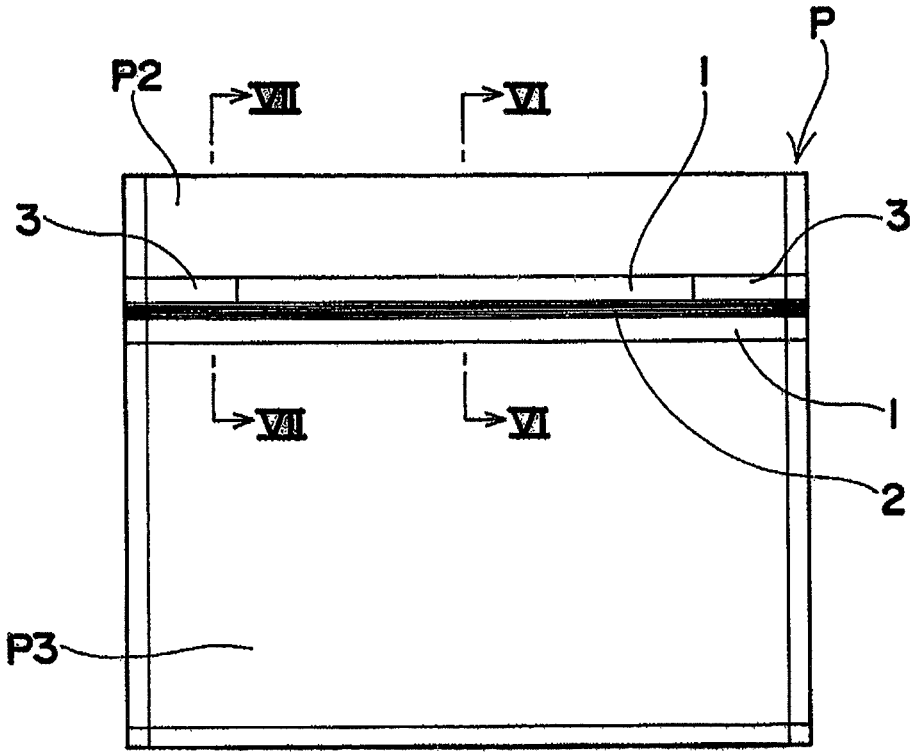
FIG. 6 is a front view of another embodiment of the present invention.

In order to release this lock structure, there is provided a releasing member 3 (See FIGS. 1 and 6). The releasing member 3 is a tongue-like member which extends from the adhesion band member 1 of the lower surface adhering fit-engagement body 10 (at either side thereof or at both sides thereof) to extend longitudinally at the upper end of the adhesion band member 1 (closest to the opening P2 of the bag. The fit-engagement body 2 is opened or released from engagement when the releasing member 3 and the side of the packaging bag P1 opposite the releasing member 3 are opened (e.g. by movement of each in opposing directions (See FIGS. 4 and 9).

The releasing member 3 may be integrally formed by cutting the upper end of the adhesion band member 1 of the lower surface adhering fit-engagement body 10 approximately along its center (See FIGS. 2 and 7) to form releasing member 3 while retaining a fit-engagement portion intact (See FIGS. 1, 4, 6, and 9). The releasing member 3 is not restricted to the shown example; it may be arbitrarily changed according to applications of the packaging bag P; for example, it is possible to leave the upper end of the adhesion band member 1 of the fit-engagement portion 2 of the lower surface adhering fit-engagement body 10 side, and form a releasing member 3 by adhering separate releasing members 3 to the upper end of the adhesion band member 1.

In the zipper according to an embodiment of the present invention, it is possible to open or release the fit-engaged fit-engagement body 2 by inserting a finger, or other item, between the male fit-engagement portion 2A and the female fit-engagement portion 2B from the releasing member 3 side (See FIGS. 4 and 9) to release the engagement between protrusion 2A and recess 2B. As a result, there is no need for a great strength at the time of opening even if the fit-engagement strength of the male fit-engagement portion 2A and the female fit-engagement portion 2B of the fit-engagement portion 2 is sufficiently enhanced.

Figure 7:
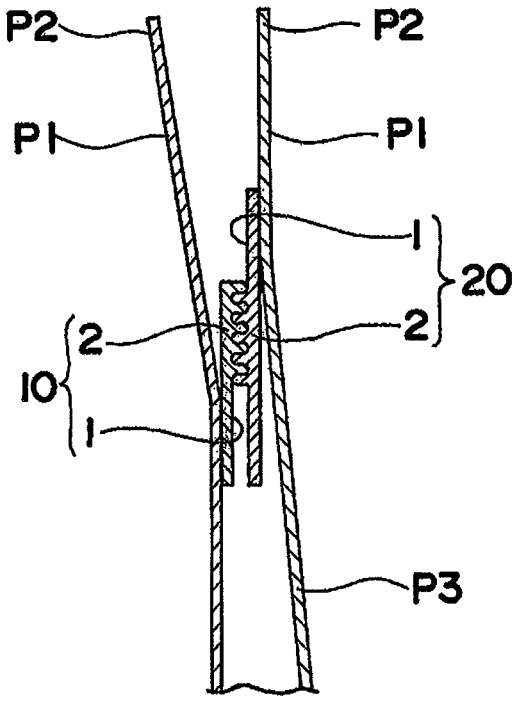
FIG. 7 is a side sectional view taken along arrow line VI-VI of FIG. 6.

In the upper surface adhering fit-engagement body 20, the adhesive surface of the adhesion band member 1 adhered to the resin sheet P1 is the surface of the adhesion band member 1 on the upper side of the fit-engagement portion 2 (the opening P2 side) (See FIGS. 2 and 7). In this upper surface adhering fit-engagement body 20, the surface of the adhesion band member 1 on the lower side of the fit-engagement body 2 (e.g. closest to the interior portion P3 side of the bag) is not adhered to the side of the packaging bag P1. Thus, it is possible to remove, e.g. cut off, the portion of the adhesion band member 1 which is not adhered.

Figure 10:
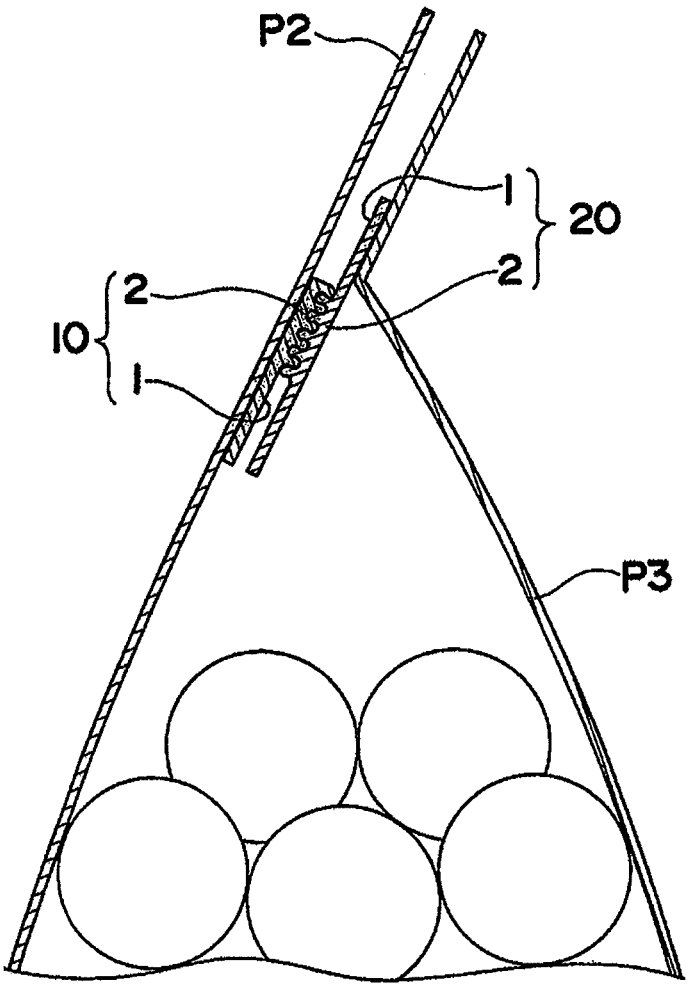
FIG. 10 is a side sectional view of a lock structure when the inside of the packaging bag is expanded.

As a result, when a large load is contained within the inside P3 of the packaging bag P, there is no opening strength or force applied to the upper adhering fit-engagement body 20 to disengage engagement of the fit-engagement body 2 (i.e. engagement of protrusion 2A and recess 2B) Thus, even if the inside P3 of the packaging bag P is greatly expanded or filled, the fit-engagement portion 2 is not opened (See FIGS. 5 and 10).

The fit-engagement body 2 shown in FIGS. 1 through 5 is composed of one male fit-engagement protrusion 2A and one female fit-engagement recess 2B. The fit-engagement body 2 shown in FIGS. 6 through 10 is composed of a plurality of male fit-engagement protrusions 2A and a plurality of female fit-engagement recesses 2B. Furthermore, although not shown, it is also possible to form the fit-engagement body 2 by a face-type male fit-engagement portion 2A and a face-type female fit-engagement portion 2B. In this way, the structure of the fit-engagement portion 2 allows arbitrary selection. Also, as the area of the fit-engagement surface of the fit-engagement portion 2 widens, it becomes possible to increase the fit-engagement strength of the fit-engagement body 2. Furthermore, even in the case of a fit-engagement body 2 of such a high fit-engagement strength, it can be readily opened from the releasing member 3.

The packaging bag according to an embodiment of the present invention may be a laminated structure such as a polyester and/or polyethylene packaging bag P equipped with a zipper as described above (See FIGS. 1 and 6). That is, the packaging bag P comprises a pair of opposing sides P1, e.g. opposing resin sheets, a pair of adhesion band members 1 respectively adhered to inner opposing surfaces of the side of the packaging bag P1, and a zipper configured to releasably engage a fit-engagement body 2 provided on the inner side surfaces of the adhesion band members 1 (See FIGS. 2 and 7).

The zipper is formed by a lower surface adhering fit-engagement body 10 and an upper surface adhering fit-engagement body 20 as described above (See FIGS. 2 and 7); and there is provided, a releasing member 3 extending from the upper end of the adhesion band member 1 of the lower surface adhering fit-engagement body 10, at the opening P2 of the bag (See FIGS. 1 and 6).

In the lower surface adhering fit-engagement body 10, the upper end of the adhesion band member 1 which is not adhered to the side of the packaging bag P1 may be cut off (See FIGS. 2 and 7). Using this construction, when accessing an object from the opening P2 of the packaging bag P, the portion of the adhesion band member 1 which is not adhered and which is removed does not constitute an obstacle. Depending upon the nature of the objects within the bag P, it is also possible to leave the portion of the adhesion band member 1 which is not adhered in place.

The packaging bag of the present invention may be any packaging bag of the type in which the fit-engaged fit-engagement portion 2 is configured not to be opened even if the opening P2 of the packaging bag P is opened and in which the fit-engagement portion 2 is opened when force is applied to the releasing member 3 and the upper surface adhering fit-engagement body 20 to open or release engagement of the engagement body to open the bag P. Thus, the packaging bag of the present invention may be any type of, for example, packaging bag equipped with a zipper as described herein, including a flat bag, as shown in the figure, and various types of gusseted bags.

Thus, as one of skill in the art will appreciate, the configuration, structure, molding method, etc., of the packaging bag P and of the present zipper, including the fit-engagement portion 2 may be modified without departing from the scope of the present invention.

DESCRIPTION OF SYMBOLS

P: Packaging bag
P1: Resin sheet
P2: Opening of bag P
P3: Inside of bag P
1: Adhesion band member
2: Fit-engagement body
2A: Male fit-engagement portion
2B: Female fit-engagement portion
3: Releasing member
10: Lower surface adhering fit-engagement body
20: Upper surface adhering fit-engagement body

The invention claimed is:

1. A child-resistant zipper comprising first and second adhesion band members each consisting of an upper and lower surface on upper and lower ends, respectively, of each adhesion band member, one surface of which is an adhesive surface for adherence to opposing inner surfaces of a packaging bag, and a fit-engagement body consisting of first and second fit-engagement portions respectively provided on opposing surfaces of the adhesion band members, wherein the first and second fit-engagement portions are adapted to releasably engage with each other to form the fit engagement body, wherein the adhesive surface of the first adhesion band member is provided on its lower surface and not its upper surface, the first fit-engagement portion is arranged along the upper end of the first adhesion band member which will not be adhered to the bag, the adhesive surface of the second adhesion band member is provided at least on its upper surface, and the second fit-engagement portion is arranged on the second adhesion band member, and wherein there is provided a tongue-like releasing member on the upper end of the first adhesion band member, the tongue-like releasing member being adapted to release engagement of the fit-engagement body when the tongue-like releasing member and the second adhesion band member are opened in opposite directions.

2. The zipper according to claim 1, wherein the second adhesion band member fit-engagement portion is arranged on the lower end of the second adhesion band member.

3. The zipper according to claim 1, wherein one of the first and second fit-engagement portion comprises at least one male fit-engagement protrusion and the other fit engagement portion comprises at least one female fit-engagement recess configured to be fit-engaged with the male fit engagement protrusion in a rib-like or face-like manner, wherein the fit-engagement of the first and second fit-engagement portions is released by inserting an item between a male fit-engagement protrusion and a female fit-engagement recess at the tongue-like releasing member side of the lower surface adhering fit-engagement body.

4. A zippered packaging bag comprising a pair of opposed sides, first and second adhesion band members each comprising an upper and lower surface on upper and lower ends thereof, one surface of which is an adhesive surface adhered to opposing inner surfaces of the opposed sides of the bag, and a zipper consisting of first and second fit-engagement portions respectively provided on opposing surfaces of the adhesion band members and configured to releasably engage to form a fit engagement body, wherein the lower surface of the first adhesion band member is adhered to the bag and the first fit-engagement portion is arranged along the upper end of the first adhesion band member and is not adhered to the bag, and the adhesive surface of the second adhesion band member is at least on its upper surface, and wherein there is provided a tongue-like releasing member on the upper end of the first adhesion band member, the tongue-like releasing member being adapted to release engagement of the fit-engagement body when the tongue-like releasing member and the second adhesion band member are opened in opposite directions.

* * * * *